US008240105B2

(12) United States Patent
Dueck

(10) Patent No.: US 8,240,105 B2
(45) Date of Patent: Aug. 14, 2012

(54) POSITIVE CONNECTOR

(76) Inventor: Vernon John Dueck, Coquitlam (CA)

( * ) Notice: Subject to any disclaimer, the term of this patent is extended or adjusted under 35 U.S.C. 154(b) by 1030 days.

(21) Appl. No.: 10/900,188

(22) Filed: Jul. 28, 2004

(65) Prior Publication Data

US 2006/0021288 A1 Feb. 2, 2006

(51) Int. Cl.
*E04C 1/00* (2006.01)
*E04C 3/22* (2006.01)
*E04C 3/20* (2006.01)

(52) U.S. Cl. ..... 52/604; 52/603; 52/607; 52/596; 405/284; 405/286

(58) Field of Classification Search ..... 405/286, 405/262, 284; 52/102, 604, 606, 605, 607, 52/596, 601, 603
See application file for complete search history.

(56) References Cited

U.S. PATENT DOCUMENTS 4,825,619 A * 5/1989 Forsberg ..... 405/286
5,044,834 A * 9/1991 Janopaul, Jr. ..... 405/284
5,114,270 A * 5/1992 Riddle ..... 405/15
5,161,918 A * 11/1992 Hodel ..... 405/286
5,248,226 A * 9/1993 Risi et al. ..... 405/284
5,252,017 A * 10/1993 Hodel ..... 411/446
D341,215 S * 11/1993 Blomquist et al. ..... D25/118
5,282,700 A * 2/1994 Rodrique ..... 405/284
5,528,873 A * 6/1996 Correia et al. ..... 52/605
5,542,787 A * 8/1996 Charlanow ..... 405/284
5,564,865 A 10/1996 Jansson
5,816,749 A * 10/1998 Bailey, II ..... 405/286
5,951,210 A * 9/1999 Maguire et al. ..... 405/286
5,984,589 A * 11/1999 Ciccarello ..... 405/284
6,019,550 A * 2/2000 Wrigley et al. ..... 405/262
6,213,688 B1 * 4/2001 Donkersloot, Sr. ..... 405/284
6,488,448 B1 * 12/2002 Blomquist et al. ..... 405/284
6,523,317 B1 * 2/2003 Bott et al. ..... 52/609
6,821,058 B1 * 11/2004 Dawson ..... 405/284
7,207,146 B1 * 4/2007 Morrell ..... 52/561
7,328,537 B2 * 2/2008 Hammer ..... 52/604
7,367,752 B2 * 5/2008 Price ..... 405/284
7,390,146 B2 * 6/2008 Rainey ..... 405/284
2002/0001509 A1 * 1/2002 Hong ..... 405/286
2002/0028114 A1 3/2002 Whitson
2003/0074856 A1 * 4/2003 Hammer ..... 52/604
2003/0118410 A1 6/2003 Race
2004/0018061 A1 1/2004 Jansson
2004/0022587 A1 2/2004 Conkel

* cited by examiner

*Primary Examiner* — Phi Dieu Tran A

(57) ABSTRACT

There is disclosed a method of connecting a geogrid to a segmental retaining wall with the use of positive connectors between upper and lower blocks.

16 Claims, 7 Drawing Sheets

POSITIVE CONNECTOR

FIELD OF THE INVENTION

This invention relates to segmental retaining walls.

BACKGROUND OF THE INVENTION

There are various ways of supporting segmental retaining walls relative to the earth to be retained, involving the use of geosynthetic grids.

SUMMARY OF THE INVENTION

There is provide a segmental block retaining wall comprising: (a) a plurality of upper blocks and lower blocks, where upper blocks are superjacent on the lower blocks, where each block has (i) a front wall; (ii) a rear wall opposed to said front wall; (iii) first and second side walls; (iv) an upper block planar surface; (v) a lower block planar surface; wherein said bottom surface has a slot having a particular concave profile extending longitudinally parallel to said front wall, and said top surface has two anchoring holes; and (b) a connector with a bottom portion having two anchor plug 320 for said anchoring holes, and a top portion for complementary tight fit for said slot, said connector extending longitudinally approximately the length of said slot; wherein said connector is tightly received in said slot and anchored in said anchoring holes, being sandwiched tightly by one upper block and one lower block.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT NOTICE REGARDING COPYRIGHTED MATERIAL

A portion of the disclosure of this patent document contains material which is subject to copyright protection. The copyright owner has no objection to the facsimile reproduction by anyone of the patent document or the patent disclosure as it appears in the Patent and Trademark Office file or records, but otherwise reserves all copyright rights whatsoever.

Figure 1:
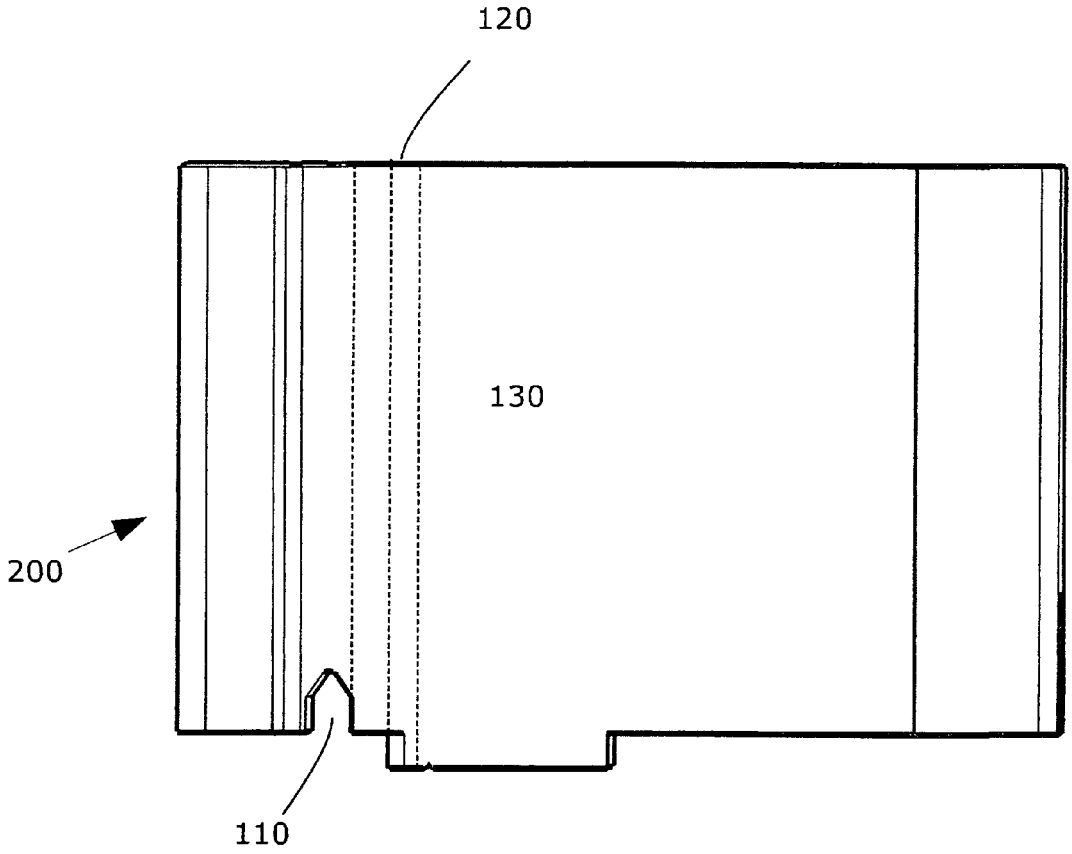
FIG. 1 shows a side view of a block according to this invention.
Figure 3:
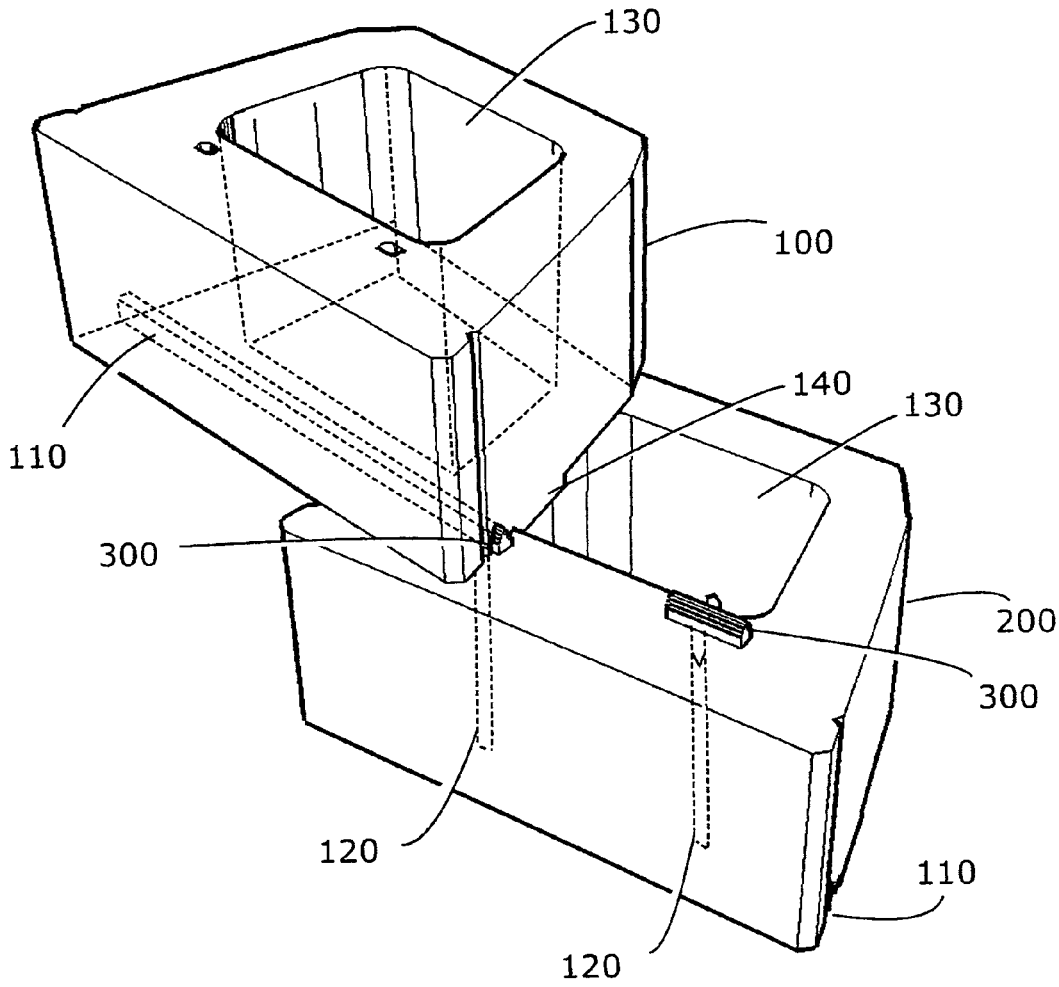
FIG. 3 shows a perspective view of a partial retaining wall being an upper block and a lower block connected with the first connector.

As seen in FIGS. 1 and 3, upper block 100 and lower block 200 are identical and their common features will be described only with respect to one or the other, for economy of expression. Block 100 has a longitudinal slot 110 extending along its bottom surface, offset inwardly from, and parallel to, the front wall of block 100. Block 100 has two anchor holes 120 on its top surface, offset inwardly from the front wall of block 100 more than aforementioned inward offset of slot 110, and are located to receive corresponding anchor plugs 320. Further details on the offsets are explained below. The profiles of slot 110 and anchor holes 120 are established to provide a snug, friction fit with connector 300.

Figure 2:
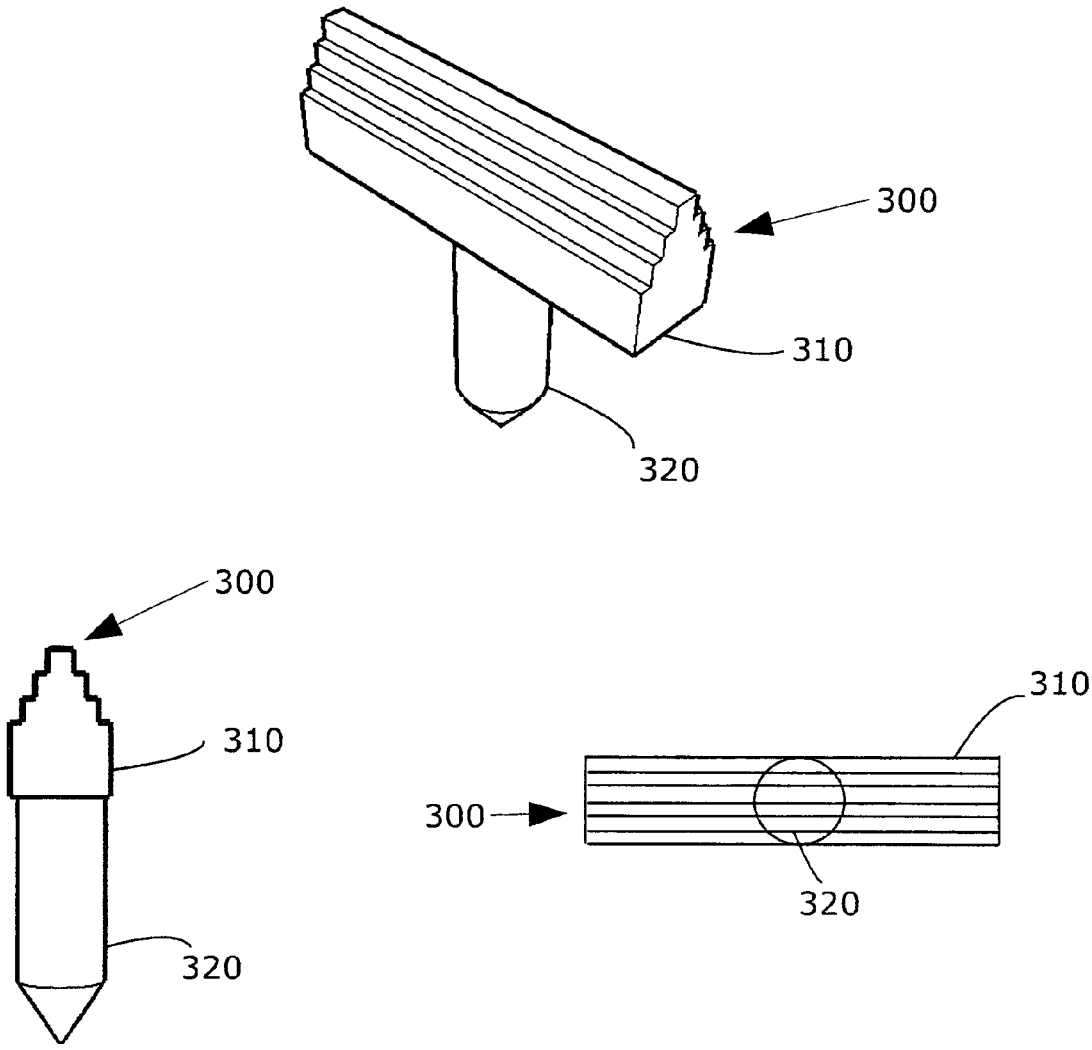
FIG. 2 shows a first connector according to this invention.

Connector 300, as shown in FIG. 2 has a top portion 310 and bottom portion or plug 320. Side and top views of connector 300 are shown in FIG. 2, with a slightly skewed perspective view. Connector bottom portion 320 is profiled and dimensioned to tightly fit into anchor holes 120 and to be rotatable therewithin. Connector top portion 310 is profiled to have a gripping surface, being edged steps in an approximate convex shape to fit within the concave profile of slot 110. Connector 300 can rotate when initially inserted into anchor holes 120 but cannot rotate within slot 110 of upper block 100 once connector 300 is received by slot 110 and wedged rigidly by the force of upper block 100 thereon against lower block 200. The length of connector 300 is short relative to the length of block 100 or block 200 and in particular, of slot 110.

As seen in FIG. 3, relative to the plane of the front wall of lower block 200, upper block 100 is rotated slightly and connector 100 is rotate slightly, so as to create a curved retaining wall if desired. A second upper block 100 is not shown for simplicity of illustration but would interact with the exposed connector 100 shown in FIG. 3, in a way similar to the illustrated upper block 100 or in an unrotated position to create a sheer face for part of the retaining wall.

Figure 4:
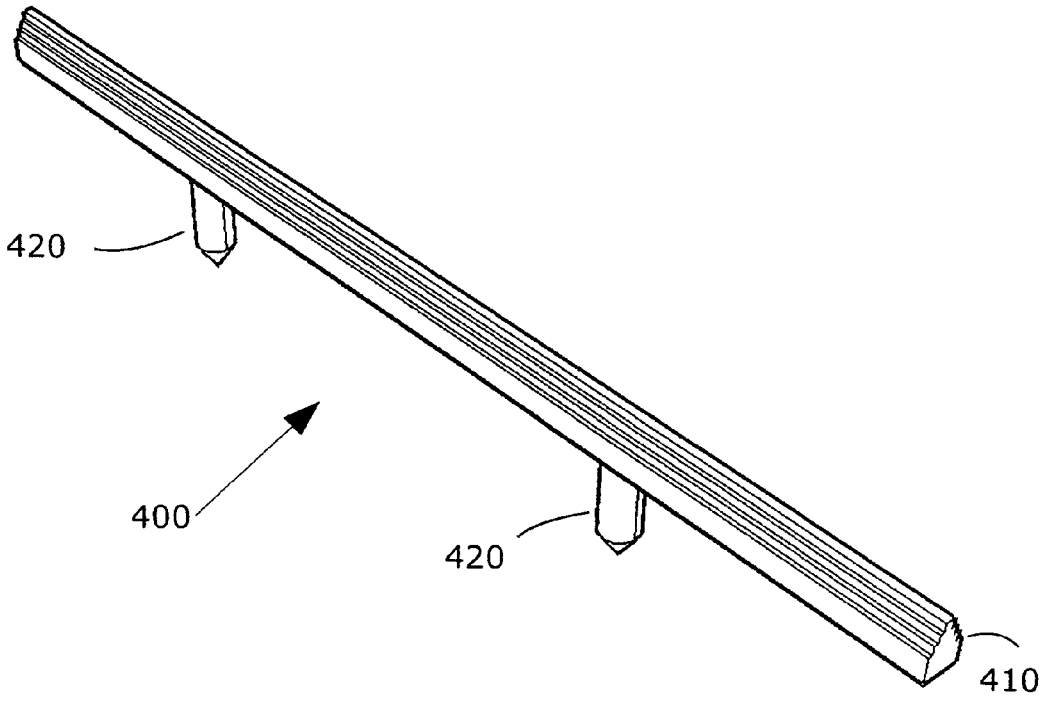
FIG. 4 shows a second connector according to this invention.
Figure 5:
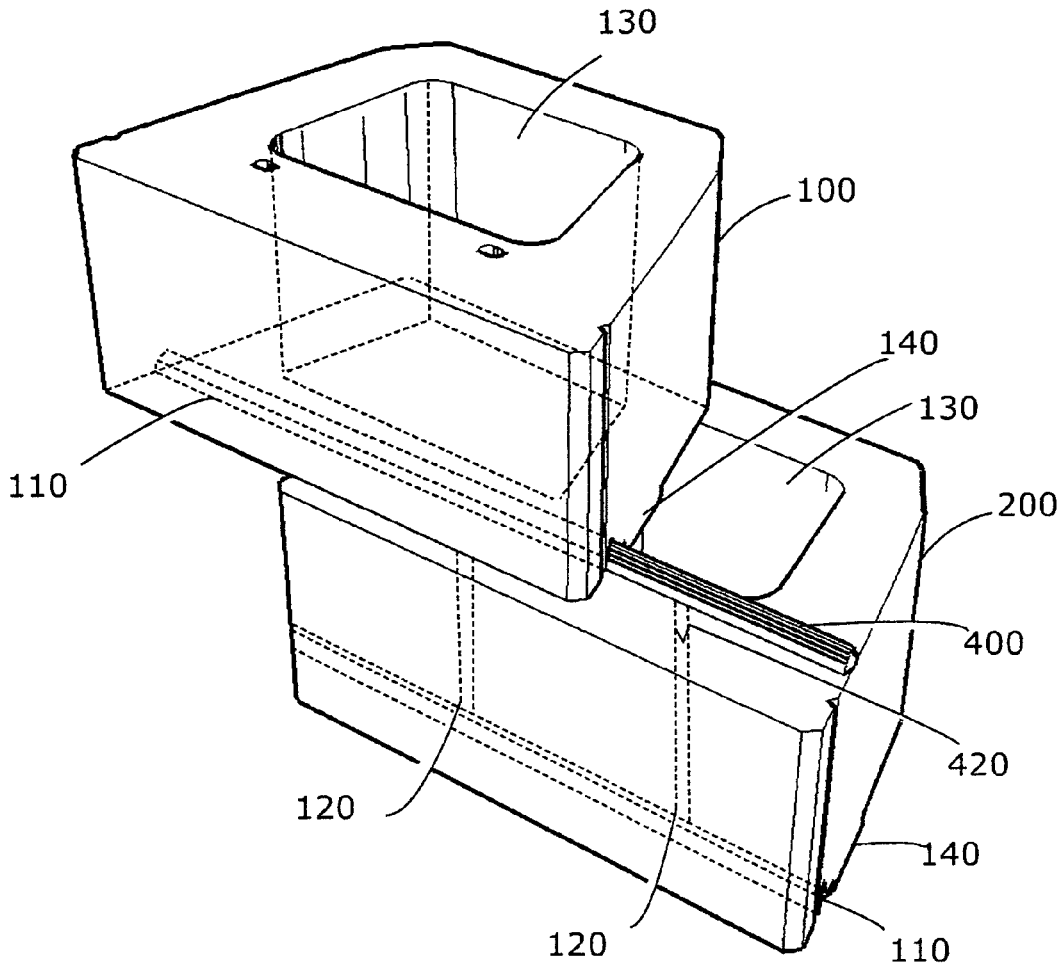
FIG. 5 shows a perspective view of a partial retaining wall being an upper block and a lower block connected with the second connector.

There is shown in FIG. 4, connector 400, which is a longer variation of connector 300. Connector 400 extends the length or approximate length of slot 110 and has two anchor plugs 420 located approximately equidistant along its length or at two other locations which correspond to the longitudinal locations of anchor holes 120 as appropriate for desired effects of anchoring.

Figure 6:
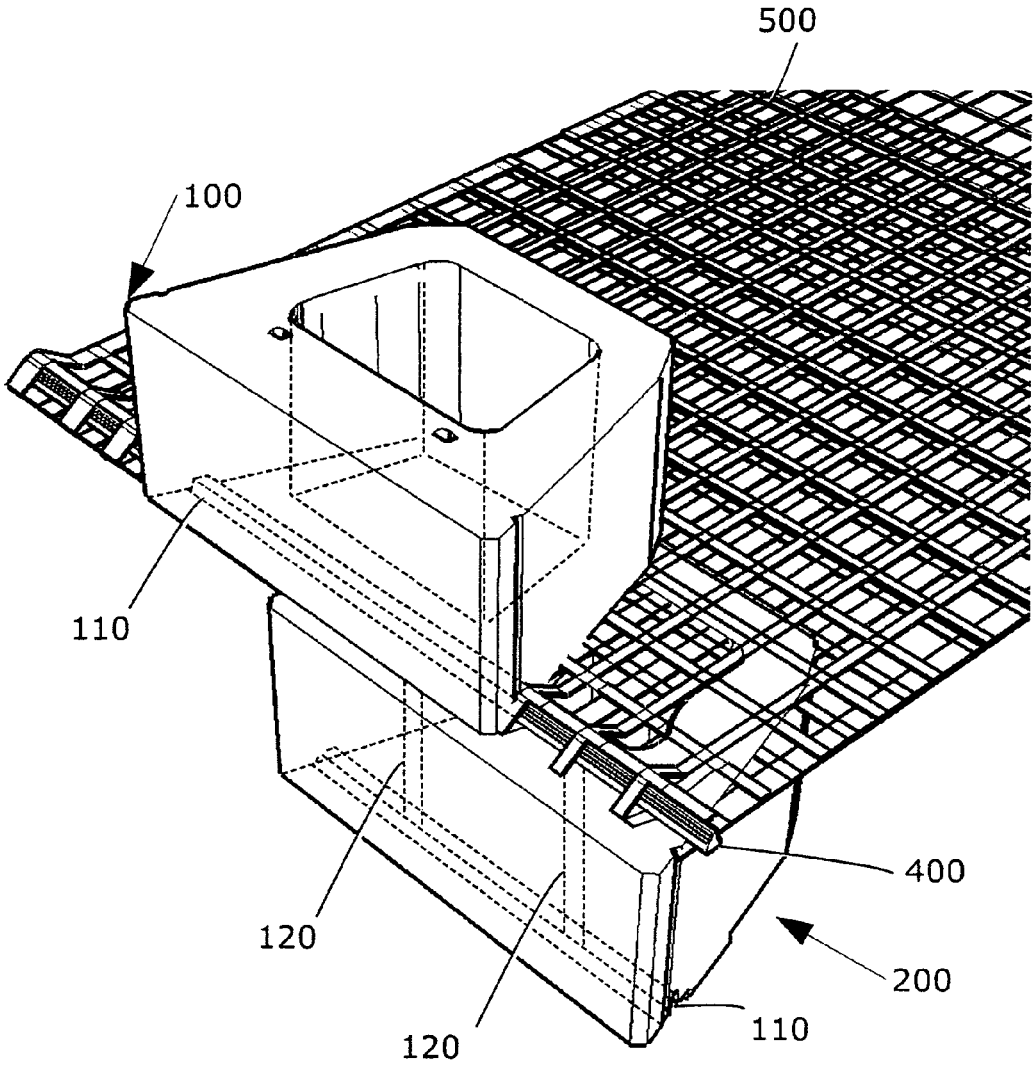
FIG. 6 shows a perspective view of the partial retaining wall of FIG. 5 with a geogrid wedged completely about the second connector.
Figure 7:
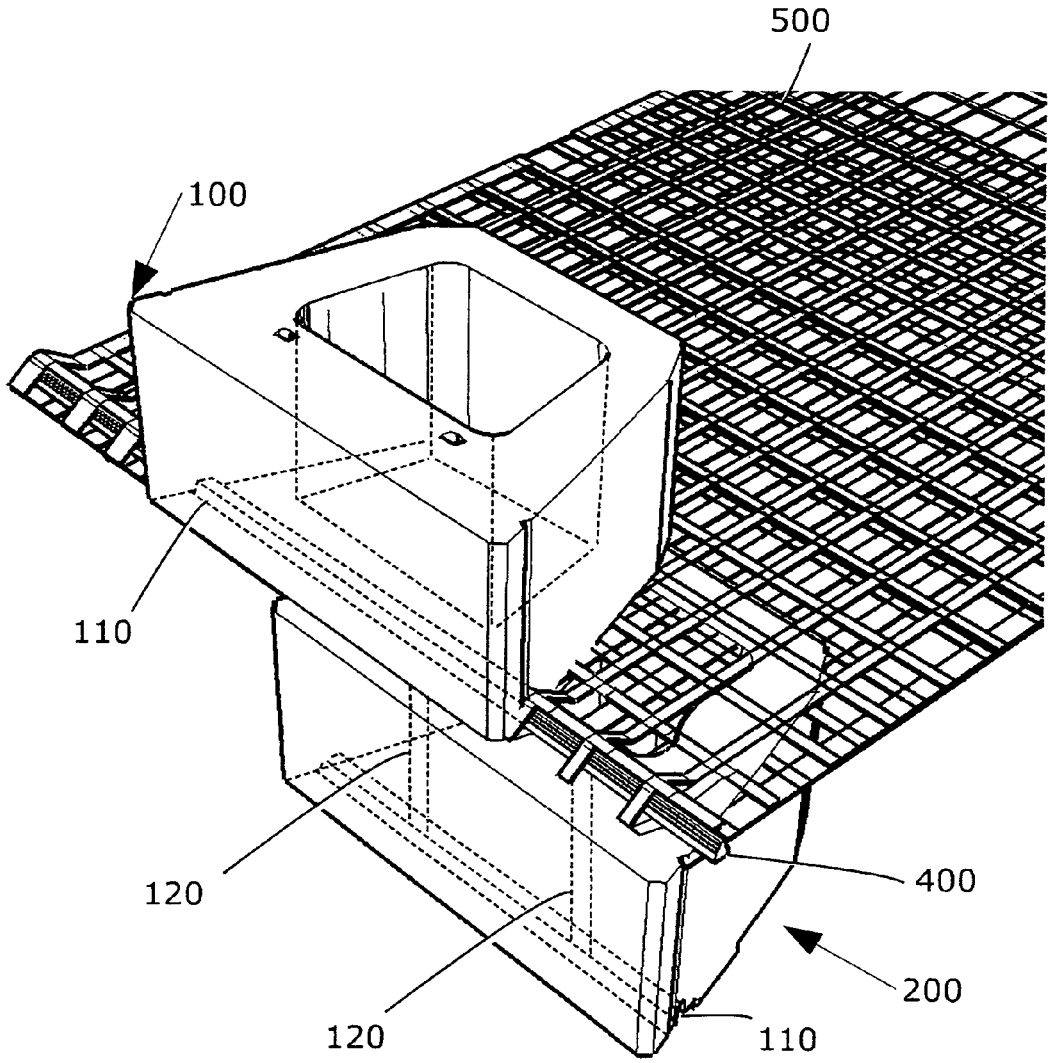
FIG. 7 shows a perspective view of the partial retaining wall of FIG. 5 with a geogrid wedged partially about the second connector.

Geosynthetic grid 500 is any conventional geosynthetic mesh grid (e.g. Geotex® GG45) or fabric (a fine mesh net) (e.g. Geotex® 12×1) wedged about connector 400, which is tightly secured between upper block 100 and lower block 200. Geosynthetic grid 500 is wedged about connector 400 in one of two ways. It can be wedged completely around connector 400, so that the live end of geosynthetic grid 500 contacts the portion of geosynthetic grid 500 within the retained earth, as seen in FIG. 6. Alternatively, geosynthetic grid 500 is wedged around only partially about top portion 410 of connector 400, and the live end of geosynthetic geogrid 500 continues along upper surface of lower block 200 towards the front wall, as seen in FIG. 7. The two anchor plugs 420 pass through the appropriate openings in geosynthetic grid 500 into corresponding anchor holes 120 of lower block 200, and so connector 400 traps and maintains geosynthetic grid 500 to the upper surface of lower block 200 by the force of gravity. Although the preceding description was for connector 400, the interaction of geogrid 500 and connector 300 is similar except for the inherent limitation that connector 300 has less contact surface with geosynthetic grid 500 because it is shorter than connector 400.

Connector 300 or connector 400 can be made of polyvinyl chloride (PVC) or other rigid polymeric material with high tensile and compressive strength, such as nylon or fiberglass reinforced polyester, or be metallic having the aforementioned properties. Although not necessary for straight retaining walls, some flexibility is desired so that, if desired in some applications, connector 400 anchored in the two anchor holes 120 of lower block 200, can be bent slightly for the formation of slightly curving retaining walls.

Block 100 is shown with two anchor holes 120. A variation (not shown) has only one anchor hole 120. The advantage is a reduction in manufacturing processes and cost but the disadvantage is being unable to receive and locate upper block 100 in parallel alignment to the front face and thus receive slot 110 of upper block 100 in a parallel alignment to create a retaining wall face whose individual blocks are all facing outwardly in the same direction. Another variation has three holes, which requires more manufacturing but has the advantage of allowing the placement of three connectors 300 for a more curved retaining wall.

The lower terminal portion 320 or 420 of connector 300 or connector 400, respectively, can be tapered to a point to facilitate the insertion of connector 300 or connector 400 into anchor hole 120, and to penetrate geosynthetic grid 500 where it is a fabric.

The side profile of slot 110 as shown in FIG. 1, is a rectangle terminating at the top with an approximate isosceles trapezoid (or a trapezoid with the nonparallel sides being congruent). The multi-stepped or multi-edged top portion 310 of connector 300 or connector provides a plurality of individual wedge points for geosynthetic grid 500 to be effected wedged to slot 110. The overall envelope shape of the resulting gripping surface of top portion 310 is complementary to the trapezoidal profile of slot 110. Other slot profiles are possible in conjunction with a complementary profile of connector top portion, including triangular or arcuate, as along as connector 300 or connector 400 fits in a tight friction fit between, and maintained by the force of gravity, upper block 100 and lower block 200.

Dimensions of connector 300 are given in FIG. 2 and dimensions of connector 400 not already given in FIG. 2, are given in FIG. 4.

Blocks for creating offset retaining walls, such as described above, are taught in more detail by U.S. Pat. Nos. 5,505,034 and 5,941,042, whose contents are incorporated herein by reference.

As shown in FIG. 1, the spatial relationship between slot 110 and anchor hole 120 (e.g. center to center) is the same spatial separation between the front of lug 140 and the front surface of cavity 130. Lug 140 of upper block 100 abuts the front of cavity 130 of lower block 200 and can be rotated accordingly but in an offset way relative to the front wall of lower block 200.

Although a block for offset retaining walls is described above, a block for creating a sheer retaining wall is of course possible. In that case, slot 110 and anchor hole 120 are aligned vertically and lug 140 aligns with the front surface of cavity 130.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "edge", "side", "front", "back", "length", "width", "inner", "outer", and similar terms are used herein, it should be understood that these terms have reference only to the structure shown in the drawings as it would appear to a person viewing the drawings and are utilized only to facilitate describing the invention.

Although blocks and connectors of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A segmental block retaining wall comprising:

(a) a plurality of upper blocks and lower blocks, where upper blocks are superjacent on the lower blocks, where each block has (i) a front wall;

(ii) a rear wall opposed to said front wall;

(iii) first and second side walls;

(iv) an upper block planar surface;

(v) a lower block planar surface;

wherein said lower surface has a slot having a concave profile extending longitudinally parallel to, and offset inwardly from, said front wall, and said upper surface has two anchor holes; and (b) a connector associated with one said lower block, having a bottom portion with two anchor plugs, each said plug for insertion into one of said two anchor holes of said lower block, and a top portion having a gripping surface of approximate convex shape in cross-section with at least three edges for complementary tight fit with said slot of one said superjacent upper block, said connector extending longitudinally approximately the length of said slot;

wherein vertical axis of said anchor hole is offset inwardly from said front wall more than said slot is; and wherein said connector is tightly received in said slot of said superjacent upper block and anchored in said anchor holes, being sandwiched tightly by said upper block and said lower block.

2. A segmental block retaining wall comprising:

(a) a plurality of upper blocks and lower blocks, where upper blocks are superjacent on the lower blocks, where each block has (i) a front wall;

(ii) a rear wall opposed to said front wall;

(iii) first and second side walls;

(iv) an upper block planar surface;

(v) a lower block planar surface;

wherein said lower surface has a slot having a concave profile extending longitudinally parallel to, and offset inwardly from, said front wall, and said upper surface has an anchor hole; and (b) a connector associated with one said lower block, having a bottom portion with an anchor plug for insertion into one said anchor hole of said lower block, and a top portion having a gripping surface of approximate convex shape in cross-section with at least three edges for complementary tight fit with said slot of one said superjacent upper block, each said connector extending longitudinally approximately a small fraction of the length of said slot;

wherein vertical axis of said anchor hole is offset inwardly from said front wall more than said slot is; and wherein said connectors are tightly received in said slot of said superjacent upper block, each said connector being anchored in one said anchor hole, being sandwiched tightly by said upper block and said lower block.

3. The segmental block wall of claim 1, further comprising a geosynthetic grid which is wedged about said connector.

4. The segmental block wall of claim 3, wherein said connector top portion has a multi-stepped surface for said geosynthetic grid to grip.

5. The segmental block wall of claim 4, wherein said superjacent upper block has a central cavity and a curved lug on its bottom surface that is displaced rearwardly of the front of said central cavity, wherein said superjacent upper block is formed into a curved wall portion relative to said lower block and wherein one of said connectors is rotated within one of said anchor holes.

6. The segmental block wall of claim 5, wherein said geosynthetic grid is wedged completely about said connector.

7. The segmental block wall of claim 6, wherein said geosynthetic grid is wedged partially about said connector.

8. The segmental block wall of claim 2, further comprising a geosynthetic grid which is wedged about said connector.

9. The segmental block wall of claim 8, wherein said connector top portion has a multi-stepped surface for said geosynthetic grid to grip.

10. The segmental block wall of claim 9, wherein said superjacent upper block has a central cavity and a curved lug on its bottom surface that is displaced rearwardly of the front of said central cavity.

11. The segmental block wall of claim 10, wherein said geosynthetic grid is wedged completely about said connector.

12. The segmental block wall of claim 11, wherein said geosynthetic grid is wedged partially about said connector.

13. The segmental block wall of claim 3, wherein said superjacent upper block has a central cavity and a curved lug on its bottom surface that is displaced rearwardly of the front of said central cavity, wherein said superjacent upper block is formed into a curved wall portion relative to said lower block and wherein one of said connectors is rotated within one of said anchor holes.

14. The segmental block wall of claim 1, wherein said superjacent upper block has a central cavity and a curved lug on its bottom surface that is displaced rearwardly of the front of said central cavity, wherein said superjacent upper block is formed into a curved wall portion relative to said lower block and wherein one of said connectors is rotated within one of said anchor holes.

15. The segmental block wall of claim 8, wherein said superjacent upper block has a central cavity and a curved lug on its bottom surface that is displaced rearwardly of the front of said central cavity.

16. The segmental block wall of claim 2, wherein said superjacent upper block has a central cavity and a curved lug on its bottom surface that is displaced rearwardly of the front of said central cavity.

* * * * *